US010405405B2

(12) United States Patent
Wendt et al.

(10) Patent No.: US 10,405,405 B2
(45) Date of Patent: Sep. 3, 2019

(54) APPARATUS, METHOD AND SYSTEM FOR CONTROLLING A LOAD DEVICE VIA A POWER LINE BY USING A POWER NEGOTIATION PROTOCOL

(71) Applicant: SIGNIFY HOLDING B.V., Eindhoven (NL)

(72) Inventors: Matthias Wendt, Würselen (DE); Marcel Beij, Sint Oedenrode (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 19 days.

(21) Appl. No.: 15/523,068

(22) PCT Filed: Oct. 5, 2015

(86) PCT No.: PCT/EP2015/072893

§ 371 (c)(1),
(2) Date: Apr. 28, 2017

(87) PCT Pub. No.: WO2016/066371

PCT Pub. Date: May 6, 2016

(65) Prior Publication Data

US 2017/0325320 A1 Nov. 9, 2017

(30) Foreign Application Priority Data

Oct. 28, 2014 (EP) ..... 14190598

(51) Int. Cl.

| | |
|---|---|
| ***H05B 37/04*** | (2006.01) |
| ***H05B 37/02*** | (2006.01) |
| ***F21S 2/00*** | (2016.01) |

(52) U.S. Cl.

CPC ..... *H05B 37/0263* (2013.01); *F21S 2/005* (2013.01); *H05B 37/0254* (2013.01); *H05B 37/04* (2013.01)

(58) Field of Classification Search

CPC ..... H05B 37/0263; H05B 37/0254; H05B 37/04; F21S 2/00; G06F 1/266; G06F 2213/0042

See application file for complete search history.

(56) References Cited

U.S. PATENT DOCUMENTS 9,583,775 B2 * 2/2017 Kim ..... H01M 8/04932
9,685,783 B2 * 6/2017 Raneri ..... H02J 3/005
(Continued)

FOREIGN PATENT DOCUMENTS

EP 2651190 A2 10/2013
WO 9849699 A1 11/1998
(Continued)

*Primary Examiner* — Phung Nguyen
(74) *Attorney, Agent, or Firm* — Meenakshy Chakravorty

(57) ABSTRACT

The present invention proposes to use a power negotiation connection (e.g. the VBUS channel) of a power delivery interface for transmitting or receiving control commands or, respectively, status information to/from a lighting device. The power negotiation connection can be used as a communication channel that is fully independent of the data connection. It uses, for example, different protocols and different wires than the data connection. Control commands, such as dim level or color, can be encoded in a vendor defined message of a related power negotiation protocol.

13 Claims, 2 Drawing Sheets

(56) References Cited

U.S. PATENT DOCUMENTS

| | | | | |
|---|---|---|---|---|
| 2007/0180174 | A1* | 8/2007 | Moosavi | G06F 13/385 710/106 |
| 2012/0224358 | A1 | 9/2012 | Noble et al. | |
| 2013/0117581 | A1* | 5/2013 | Katkade | G06F 1/266 713/300 |
| 2014/0070700 | A1* | 3/2014 | Genthon | H05B 33/0854 315/83 |
| 2014/0098519 | A1 | 4/2014 | Chien | |
| 2014/0173141 | A1* | 6/2014 | Waters | G06F 1/22 710/16 |
| 2014/0191682 | A1 | 7/2014 | Pederson | |
| 2014/0208134 | A1 | 7/2014 | Waters et al. | |
| 2014/0308045 | A1 | 10/2014 | Pederson | |

FOREIGN PATENT DOCUMENTS

| | | | |
|---|---|---|---|
| WO | 03083677 | A2 | 10/2003 |
| WO | 2009103245 | A1 | 8/2009 |
| WO | 2011056242 | A1 | 5/2011 |
| WO | 2013045189 | A1 | 4/2013 |

* cited by examiner

APPARATUS, METHOD AND SYSTEM FOR CONTROLLING A LOAD DEVICE VIA A POWER LINE BY USING A POWER NEGOTIATION PROTOCOL

CROSS-REFERENCE TO PRIOR APPLICATIONS

This application is the U.S. National Phase application under 35 U.S.C. § 371 of International Application No. PCT/EP2015/072893, filed on Oct. 5, 2015, which claims the benefit of European Patent Application No. 14190598.4, filed on Oct. 28, 2014. These applications are hereby incorporated by reference herein.

FIELD OF THE INVENTION

The invention relates to the field of an apparatus, method and system for controlling a load device, such as a lighting device or sensor device.

BACKGROUND OF THE INVENTION

US 2013/0117581 A1 discloses a method, in which a first device provides a first power to a second device using a first set of conductors out of a plurality of conductors. The first device provides, in response to receiving a notification, a second power to the second device using the first and a second set of conductors out of a plurality of conductors. The notification indicates that the second device can be supplied with a second power using the first set of conductors and a second set of conductors out of the plurality of conductors, and can also specify the configuration for enabling the second power. "Mixed lines" for both power delivery and data transmission in the context of power negotiation are described and used as follows. At a start of the power negotiating protocol, an initial power is provided to a load device by a power supply using a first set of conductors. A power negotiating protocol may be initiated upon first coupling the load device and the power supply, or when being turned on after being in a power-off state. Once the load device receives this initial power, it can send a notification to the power supply using their connection via the first set of conductors. This notification can indicate that the load device can be supplied with a second power using a second set of conductors. The power supply can then provide a second power to the load device using both the first and second sets of conductors.

SUMMARY OF THE INVENTION

The present invention provides an apparatus as claimed in claim 1, a load device as claimed in claim 6, a power supply device as claimed in claim 8, a system as claimed in claim 9, a method as claimed in claim 12, and a computer program product as claimed in claim 13.

According to a first aspect of the invention, an apparatus for controlling a load device according to the present invention comprises:

a control unit adapted to use a power negotiation protocol signaling in order to exchange at least one of control and status information with the load device; and a transceiver for transmitting or receiving the control or status information to/from the load device over a power line used for supplying power to said load device.

The control unit is adapted to use a USB Power Delivery power negotiation protocol to exchange the control or status information.

The invention is based on the following considerations.

Universal Serial Bus (USB) is an industry standard developed in the mid-1990s that defines cables, connectors and communications protocols used in a bus for connection, communication, and power supply between computers and electronic devices. USB was designed to standardize the connection of computer peripherals (including keyboards, pointing devices, digital cameras, printers, portable media players, disk drives and network adapters) to personal computers, both to communicate and to supply electric power. It has become commonplace on other devices, such as smart phones, PDAs and video game consoles. USB has effectively replaced a variety of earlier interfaces, such as serial and parallel ports, as well as separate power chargers for portable devices.

The design architecture of USB is asymmetrical in its topology, consisting of a host, a multitude of downstream USB ports, and multiple peripheral devices connected in a tiered-star topology. A USB host may implement multiple host controllers and each host controller may provide one or more USB ports. USB devices are linked in series through hubs. One hub built into the host controller is the root hub.

USB has evolved from a data interface capable of supplying limited power to a primary provider of power with a data interface. Today, many devices charge or get their power from USB ports contained in laptops, cars, aircraft or even wall sockets. USB has become a ubiquitous power socket for many small devices such as cell phones, MP3 players and other hand-held devices. Users need USB to fulfil their requirements not only in terms of data but also to provide power to, or charge, their devices simply, often without the need to load a driver, in order to carry out "traditional" USB functions.

Further details can be gathered from "USB Power Delivery", Website, 15.11.2013, online available at http://www.usb.org/developers/powerdelivery/, and from Brad Saunders, USB 3.0 Promoter Group: USB 3.0 Promoter Group Announces Availability of USB Power Delivery Specification; HILLSBORO, Oreg.—Jul. 18, 2012; online available at http://www.usb.org.

USB powered lighting devices (e.g. luminaires) or other type of load device can be configured to only take power from the USB port. In some cases manually operated switches may be installed with a luminaire or on the cable. However, the length of the USB cable is limited. More specifically, the USB specification limits the length of a cable run to 5 m for USB 2.0 high-speed applications or 3 m for USB 1.1 low-speed devices. Essentially, this means that it is not possible to "daisy-chain" several USB extensions cables together and run them more than 5 m. Most USB cables fall under the USB 2.0 high-speed specification and have the 5 m limit. In order to go beyond these limits, hubs, active extension cables or USB over Ethernet products are required.

An upcoming trend is to use USB for direct current (DC) supply of many consumer devices. Therefore, a new standard USB-PD (USB Power Delivery) has been developed in order to support up to 100 W power to be supplied from one side of a USB connection to the other side and to provide negotiation capability over the power supply line ($V_{BUS}$) only.

Accordingly, since according to the present invention control and status information can be transferred via the power line using a USB-PD power negotiation protocol, no separate data connection is required for exchanging commands or status information with the load device. The load device therefore does not need capabilities for specific data connections (e.g. USB connection), so that the connection cable (e.g. USB cable) can be reduced to the power supply wire(s), e.g., two USB lines and pins. As a result, typical cable length limitations (e.g. those of USB cables) can largely be overcome.

Furthermore, the use of the USB-PD power negotiation protocol used to exchange the control or status information provides the advantage that modem circuits and/or functions already provided in the USB-PD devices can be used for implementing the proposed control and status signaling.

In one embodiment, the apparatus is adapted to encode the control and/or status information in a vendor defined message according to the USB Power Delivery power negotiation protocol. Preferably, the control unit is adapted to encode the control and/or status information in a vendor defined message according to the USB Power Delivery power negotiation protocol.

In one embodiment, the control unit is adapted to use the USB-PD negotiation protocol only for providing a control channel to the load device without making use of actual USB-PD negotiation at all. A single pair cable can be used in implementing this control channel.

According to an embodiment, which can be combined with any of the above embodiments, the proposed signaling is used for transferring control commands or status packets from/to a lighting control system. Thereby, the proposed signaling can be used for controlling lighting devices without requiring any additional control lines. The lighting control system can be implemented for instance by one or more central lighting control computing devices. In operation, such lighting control computing devices are connected for communication with one or more lighting devices, which form load devices. The lighting control system serves for overall control of a lighting system comprising a plurality of lighting devices as load devices. In a variant, one apparatus of this embodiment is provided as a part of the lighting control system and another apparatus of this embodiment is provided as a part of the load device. Thus, the embodiment proposes the use of USB-PD for an exchange of control commands or status information in the exchange between a lighting control system and at least one load device in lighting systems.

In a specific example of this embodiment, the apparatus is adapted to receive or transmit the control commands or the status packets from or to the lighting control system by using the UPnP lighting control protocol. Thereby, the proposed power line signaling using USB-PD can be advantageously applied in UPnP systems.

According to a further embodiment, which may be combined with any of the above embodiments, the apparatus is adapted to signal to a user or an installer information, which indicates a successfully established communication channel over the power line to the load device. Thereby, it can be readily determined that a load device supports the proposed functionality and that the connection is active.

A second aspect of the present invention is formed by a load device comprising the apparatus of the first aspect or one of its embodiments.

In operation, the load device advantageously uses the apparatus for receiving and transmitting control and status information with a power supply device that also comprises an apparatus according to the first aspect of the invention or any of its embodiments, or with a lighting control system that also has an apparatus according to the first aspect of the invention or any of its embodiments.

A third aspect of the present invention is formed by a power supply device comprising an apparatus of the first aspect of the invention or any of its embodiments.

In operation, the power supply device advantageously uses the apparatus for receiving and transmitting control and status information with a load device that also comprises an apparatus according to the first aspect of the invention or any of its embodiments, or with a lighting control system that also has an apparatus according to the first aspect of the invention or any of its embodiments. In one embodiment, the power supply device also forms the lighting control system. In particular, the power supply device of such an embodiment comprises one or more central lighting control computing devices. In another embodiment, the lighting control system is device that is separate from the supply device and comprises an apparatus of the first aspect or one of its embodiments.

According to an embodiment which may be combined with any of the above embodiments, the power supply device comprises a USB-PD power supply unit having a power input and a data port. Thus, external control data can be supplied, for instance from the power supply device, to the load device and status data from the load device can be output via the data port.

According to a fourth aspect of the invention, a hub device is provided. The hub device can be combined with any of the above embodiments. The hub device has a power supply from mains and is configured to support a data connection with an external device, such as a load device or a lighting control system, supporting Universal Plug and Play (UPnP). The hub device is adapted to relay messages between vendor specific lighting codes and lighting related UPnP package. The hub of the third aspect of the invention embodiment allows connection of a USB powered lighting device to a UPnP network.

In particular embodiments, the hub device is configured to support a data connection using a Universal Plug and Play (UPnP) protocol. The hub device further has an apparatus according to the first aspect of the invention for relaying messages between lighting related UPnP packages and vendor specific messages under the USB-PD protocol. UPnP packages may be received or transmitted using a USB connection or any other data connection supporting UPnP. The vendor specific message preferably transport lighting codes for controlling operation of a lighting device, or for providing status information on an operational status of the lighting device.

A fifth aspect of the invention is formed by a system comprising a power supply device of the third aspect or one of its embodiments, and further comprising at least one load device of the second aspect of the invention or one of its embodiments, which is connected to the power supply device.

A sixth aspect of the invention is formed by a method of controlling a load device. The method comprises:

using a power negotiation protocol signaling in order to exchange at least one of control and status information with the load device; and transmitting or receiving the control or status information over a power line used for supplying power to the load device, wherein the power negotiation protocol used to exchange the control or status information is a USB Power Delivery protocol.

A seventh aspect of the invention is formed by a computer program product comprising code means for producing the steps of the method of the sixth aspect when run on a computing device.

It shall be understood that the apparatus of claim 1, the load device of claim 6, the power supply device of claim 8, the system of claim 9, the method of claim 12, and the computer program product of claim 13 have similar and/or identical preferred embodiments, in particular, as defined in the dependent claims.

It shall be understood that a preferred embodiment of the present invention can also be any combination of the dependent claims or above embodiments with the respective independent claim.

These and other aspects of the invention will be apparent from and elucidated with reference to the embodiments described hereinafter.

DETAILED DESCRIPTION OF EMBODIMENTS

The following embodiments are directed to a power negotiation connection (i.e. the $V_{BUS}$ channel) of a USB-PD interface for transmitting control commands to a lighting device. This power negotiation connection is a communication channel that is fully independent of the data connection. It uses, for example, different protocols and different wires than the data connection.

Figure 1:
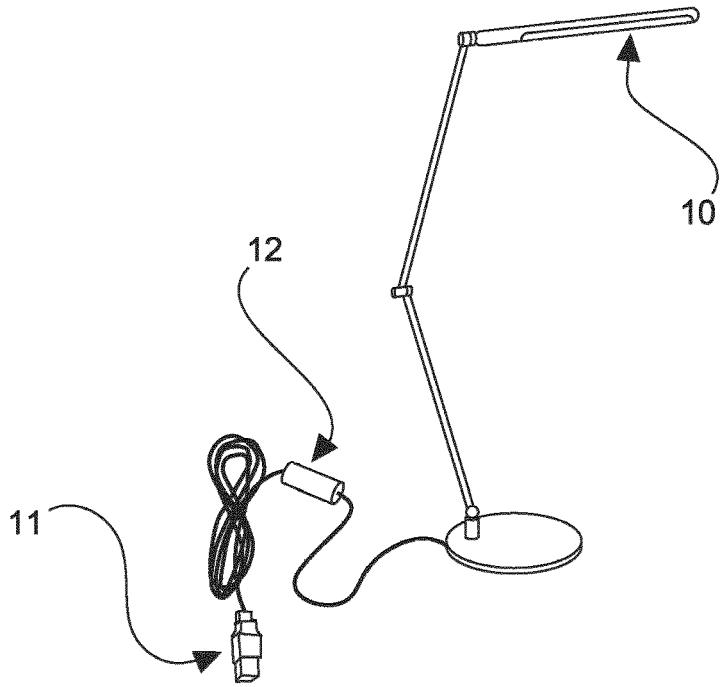
FIG. 1 shows a lighting device which is powered by a USB connection.

FIG. 1 shows an exemplary power control system where a desk lamp is powered by USB. The USB powered desk lamp comprises a number of light emitting diodes (LEDs) mounted in a head 10 of the desk lamp, a cable with USB connector 11 at the end, and potentially a driver box that has a manually operated switch 12.

Conventionally, for control of the desk lamp from USB side a USB enumerated plug and play control system needs to be added requiring also data lines to be connected.

A first beneficial feature of the USB-PD standard is exploited, namely the feature that power negotiation is also available when power supply is active and electrical current is flowing. This is different from other systems, such as Power over Ethernet (PoE), where a negotiation is only possible for a fresh connection before the supply voltage is switched on. A second beneficial feature is that negotiation is mainly not using the USB data connection channel. However a new connection channel has been developed for power delivery, which is using the power conductors for the data connection in parallel by installing powerline modems on both sides of the USB connection.

In the embodiments, the power negotiation connection is suggested to be additionally used for control of the USB powered load or end device. This is beneficial as the power negotiation connection is totally independent of the USB data connection and the related processing. In addition, a cabling with only two wires is required for power supply and control, leaving the data pins of the USB connection totally open.

Thus, using the power negotiation channel of USB-PD for control signaling between load device and host reduces the required cables, makes maximum use of installed copper, and allows increased cable lengths.

Moreover, as the modem devices for the new negotiation channel are indispensable for USB-PD, it is expected that related standardized chips will be available at low cost in the future. The negotiation channel can be used for transmitting manufacturer specific codes via the power supply line to the controlled load device. This can be achieved via proprietary manufacturer related codes.

For USB-PD, the current standard USB Power Delivery Specification Revision 1.2 is online available at www.usb.org, which describes the negotiation technique using a dedicated communication channel.

Figure 2:
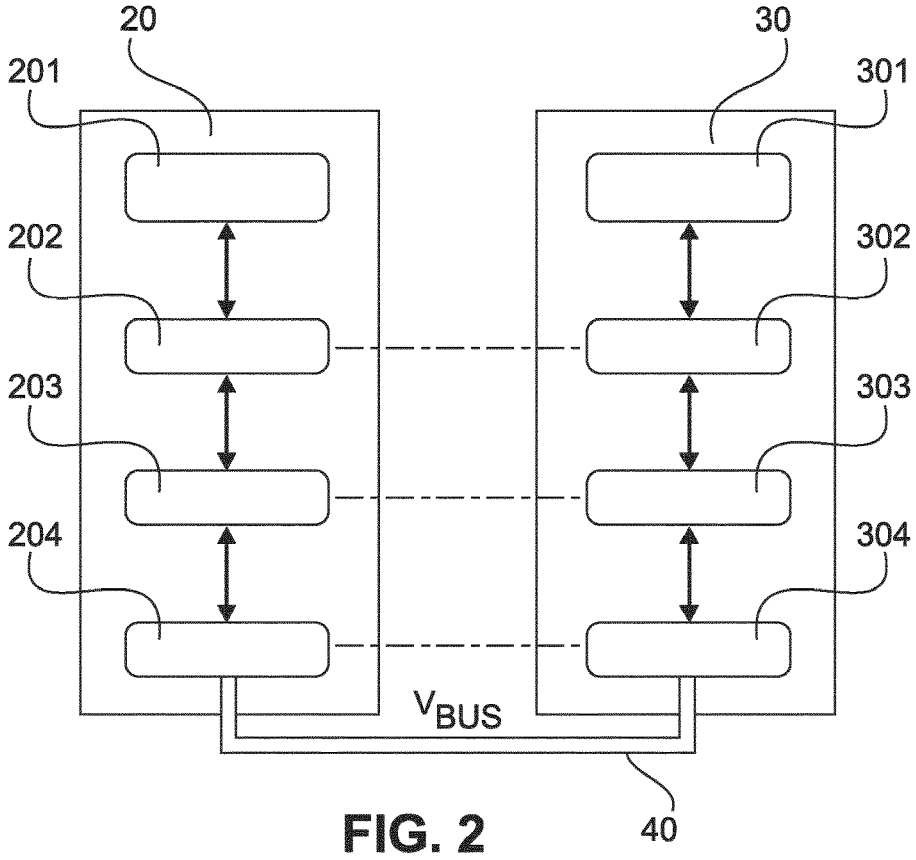
FIG. 2 shows a USB power delivery communications stack.

FIG. 2 shows a USB-PD communication stack between a power supply device 20 and a load device 30, wherein a physical layer (PHY) functionality 204 of this channel at the power supply device 20 and a physical layer functionality 304 of this channel at the load device 30 are responsible for sending and receiving messages across the power line 40 (i.e. $V_{BUS}$). Both physical layer (PHY) functionalities 204, 304 comprise a transceiver that superimposes a signal on the power supply line 40 and are responsible for managing data on the power supply line 40. This includes—among others—avoiding collisions on the power supply line 40 and recovering from such collisions when they occur. They also detect errors in the messages using a cyclic redundancy code check (CRC).

Additional functionalities on both sides at higher layers of the communication stack are respective protocol functionalities 203, 303, policy engine functionalities 202, 302, and device policy manager functionalities 201, 301. Information is successively transferred and converted through all layers of the communication stack in the downward direction at one communication end and then via the power supply line 40 to the other communication end where it is successively transferred and converted through all layers of the communication stack in the upward direction, and vice versa. Thereby, the device policy manager 201 at the power supply device 20 can exchange information with the device policy manager 301 at the load device 30.

The USB-PD specification allows for a data message to be communicated over the $V_{BUS}$ channel for power negotiation, for performing a self-test, yet also for transferring a vendor specific code.

According to the embodiments, control commands for the USB powered load device, such as dim level and color in case of a lighting device or other commands related to the functionality of the load device, can be encoded in the vendor defined message. This has several benefits over using the data connection for communicating such commands to the lighting device. The load device does not need capabilities for the USB data connection and the USB power supply and control connection can be simplified to only two wires and pins. As a result, the typical cable length limitation of USB can be largely overcome.

USB-PD uses a carrier of 23.2 MHz modulated with the information to avoid any noise from the power supplies. Continuous Phase Frequency Shift Keying (FSK) is used to encode bits of the control commands or status information for transmission on the $V_{BUS}$ channel. The used bit rate may be in the order of 300 Kbps. Of course, the present invention is not limited to such kind of modulation, carrier frequency or data rates.

The USB-PD V. 1.2 specification defines control messages and data messages which can be used in the present embodiments to exchange control and status information between power supply side and the powered load side.

Three types of data messages can be used to exchange information between a pair of port partners and range from 48 to 240 bits in length. Those used to expose capabilities and negotiate power, those used for the built-in self-test (BIST) and those which are vendor defined and which can be used for signaling the additional control and status information of the present embodiments.

One vendor defined message (VDM) code has been defined. The VDM that is suggested to be used for transferring control and/or status information for a load device consists of a header, vendor ID and one or more 'objects' (16 bits for the first object, 32 bits for each subsequent object). To ensure vendor uniqueness of VDMs, all VDMs shall contain a USB vendor identity (ID) in the first VDM object. The VDM consists of at least one data object, the first VDM object, and may contain up to a maximum of six additional VDM objects. If a port at a load device receives a VDM that it does not know, it may simply ignore the message.

In case of lighting devices or lamps, vendor defined codes may be provided for e.g. lamp status, type, colors available, temperature, age, efficiency etc. In addition, control messages can be provided for controlling the lighting device, such as e.g. setting flux-level, percentage of max power (dim level), color temperature color etc.

As the negotiation can be achieved by only using the power contacts, such a proposed lighting device can be connected only over a single pair cable not wasting copper and isolation for data connection.

Figure 3:
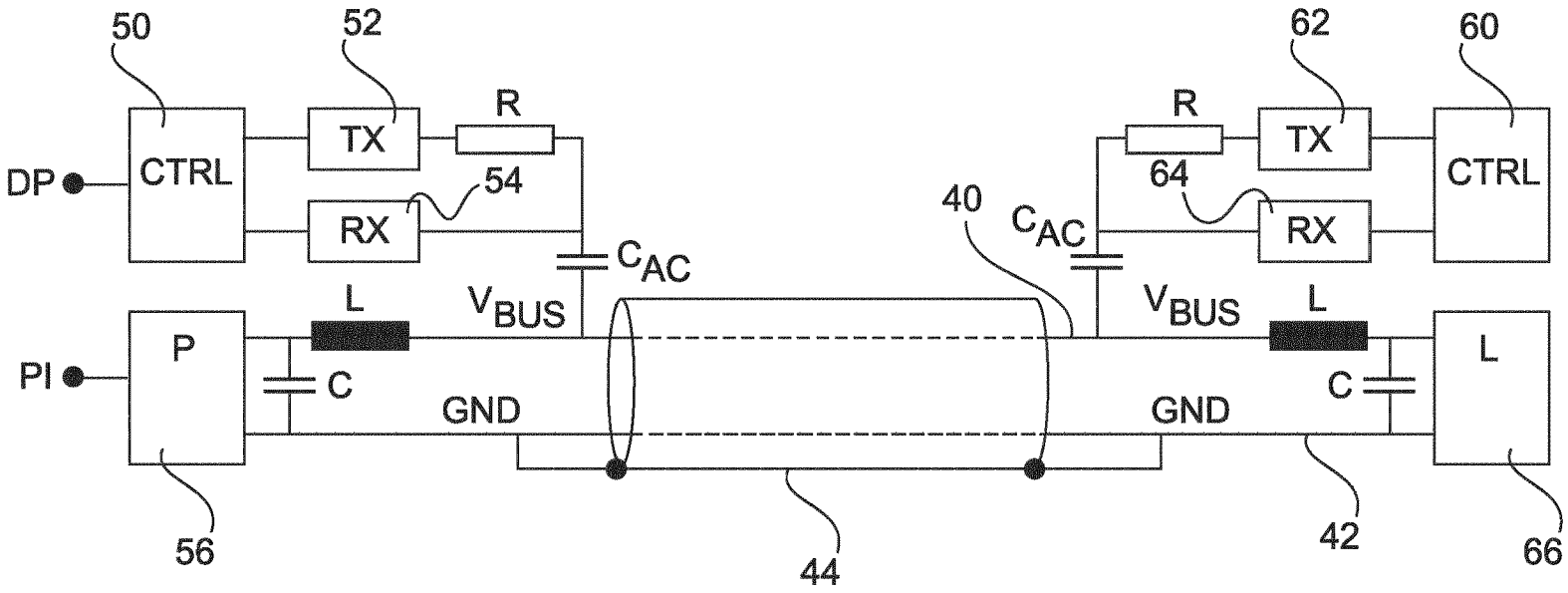
FIG. 3 shows a schematic block diagram of control system according to an embodiment of the present invention.

FIG. 3 shows a schematic block diagram of a control system according to a first embodiment. At the USB power supply end (e.g., USB host or hub), a power supply unit (P) 56 is adapted to convert an alternating current AC power input supplied to a power input terminal PI into a required DC power. The DC power is supplied via a capacitance C and an isolation reactance L to the power supply line ($V_{BUS}$) 40 which may optionally be shielded by a grounded coaxial shielding 44 together with the second ground (GND) line 42. At the other end of the USB cable, the DC power is supplied to a load device (L) 66 via another capacitance C and isolation reactance C which are used for suppressing undesired AC components.

According to the first embodiment, a data port DP is provided at the power supply side so as to input or output control or status data exchanged via the power supply line 40. To achieve this, a control unit 50 and a transceiver which consists of a transmitter part (TX) 52 and a receiver part (RX) 54 are provided to generate the above mentioned vendor defined message (VDM) based on input data supplied via the data port DP and to transmit or, respectively, receive VDMs via the power supply line 40. The transmitter part 52 is adapted to modulate the VDM according to the USB-PD specification and the receiver part 54 is adapted to demodulate a received VDM according to the USB-PD specification. The modulated VDM is then coupled to the power supply line 40 via an AC coupling capacitance $C_{AC}$. The resistance R at the output of the transmitter part 52 serves to adapt the output resistance of the transmitter part 52 to the resistance of the USB cable.

A similar configuration with a control unit 60, a transceiver consisting of a transmitter part 62 and a receiver part 64, a resistor R and an AC coupling capacitor $C_{AC}$ is provided at the load device 66. As these components function in the same manner as the corresponding components at the power supply side, a detailed description is omitted here. Additionally, the control unit 60 can be coupled to the load device 66 so as to control the load device 66 based on a received control command or to detect a status which is to be signaled towards the power supply device.

Thereby, status and control information forwarded via modulated VDMs coupled to the power supply line 40 can be exchanged between the power supply device and the load device. As an example, the power supply device may transmit control messages to the load device so as to control a functionality of the load device, and the load device my transmit a status information to the power supply device so as to indicate a predetermined status. As an example of such status information, an indicator may be used to signal to an installer or user that a connection to a lighting device using USB-PD negotiation channel for controls has been established.

In the above first embodiment, the USB-PD negotiation modems provided for the power negotiation via the power supply line $V_{BUS}$ can be "misused" only for a control channel to a load device connected via a single pair cable without making use of USB-PD negotiation at all. This may be very beneficial as the related chips are supposed to be available in high volume at low price. The controlled load device 66 is thus only connected with two poles and still controllable.

According to a second embodiment, the proposed message transfer via the USB power supply line is used for relaying UPnP lighting control messages, e.g., from a USB data channel. In UPnP networking, each device has a Dynamic Host Configuration Protocol (DHCP) client and searches for a DHCP server when the device is first connected to the network. If a DHCP server is available, i.e., the network is managed, the device uses the IP address assigned to it. If no DHCP server is available, i.e., the network is unmanaged and the device uses Auto IP to get an address. To control a UPnP device, a control point invokes an action on the device's service. To do this, a control point sends a suitable control message to the control URL for the service. In response, the service returns any results or errors from the action. The effects of the action, if any, may also be modeled by changes in the variables that describe the run-time state of the service. When these state variables change, events are published to all interested control points.

As an additional building block of the second embodiment a lighting grade USB-PD hub is proposed having a power supply from mains and a USB or any other data connection supporting UPnP. The hub is relaying all messages between vendor specific USB-PD lighting codes and lighting related UPnP package. The related messages are published by the UPnP Forum in "Lighting Controls V 1.0" online available at http://upnp.org.

Using the proposed signaling for UPnP makes special sense as the typical protocols used on USB connections are related with UPnP. But also other lighting control languages or protocols (among others: XCLIP, DALI, KNX etc.) can be supported in the same way.

To summarize, it has been proposed to use a power negotiation connection (e.g. the $V_{BUS}$ channel) of a power delivery interface for transmitting or receiving control commands or, respectively, status information to/from a load device. The power negotiation connection can be used as a communication channel that is fully independent of the data connection. It uses, for example, different protocols and different wires than the data connection. Control commands, such as dim level or color, can be encoded in a vendor defined message of a related power negotiation protocol.

The present invention is not restricted to the above embodiments and not limited to USB connections. It can be used in any interface or connection technology where a power negotiation function via a power supply line is provided, and for any kind of load devices and, more specifically, for any kind of indoor lighting and/or connection of LED module(s) inside a luminaire or for any kind of sensor device.

Other variations to the disclosed embodiments can be understood and effected by those skilled in the art in practicing the claimed invention, from a study of the drawings, the disclosure, and the appended claims.

Any processing and/or control and/or signaling functions of the described embodiments can be implemented as program code means of a computer program and/or as dedicated hardware. The computer program may be stored/distributed on a suitable medium, such as an optical storage medium or a solid-state medium, supplied together with or as part of other hardware, but may also be distributed in other forms, such as via the Internet or other wired or wireless telecommunication systems.

In the claims, the word "comprising" does not exclude other elements or steps, and the indefinite article "a" or "an" does not exclude a plurality.

A single processor or other unit may fulfill the functions of several items recited in the claims. The mere fact that certain measures are recited in mutually different dependent claims does not indicate that a combination of these measures cannot be used to advantage.

The invention claimed is:

1. An apparatus for controlling a load device, said apparatus comprising:

a control unit adapted to use a power negotiation protocol signaling in order to exchange at least one of control and status information with the load device, wherein the power negotiation protocol used to exchange the control or status information is a USB Power Delivery power negotiation protocol; and a transceiver for transmitting or receiving, only via power supply USB pins, the control or status information to/from the load device over a power line used for supplying power to said load device.

2. The apparatus according to claim 1, wherein the control unit is adapted to encode the control or status information in a vendor defined message according to the USB Power Delivery power negotiation protocol.

3. The apparatus according to claim 1, which is adapted to receive or transmit control commands or status packets from/to a lighting control system.

4. The apparatus according to claim 3, wherein the apparatus is adapted to receive or transmit the control commands or the status information from/to the lighting control system by using a UPnP lighting control protocol.

5. The apparatus according to claim 1, which is adapted to signal to an installer or user an information which indicates a successfully established communication channel over the power line to the load device.

6. A load device comprising an apparatus according to claim 1.

7. The load device of claim 6, wherein said load device is a lighting device or a sensor device.

8. A power supply device comprising an apparatus of claim 1.

9. A system comprising a power supply device of claim 8 and at least one load device of claim 6 which is connected to the power supply device.

10. The system of claim 9, wherein the power supply device comprises a USB-PD power supply unit having a power input (PI) and a data port (DP).

11. The system of claim 9, further comprising a hub device having a power supply from mains and a data connection supporting UPnP, wherein the hub device is adapted to relay messages between vendor specific lighting codes and lighting related UPnP packages.

12. A method of controlling a load device said method comprising:

using a power negotiation protocol signaling in order to exchange at least one of control and status information with the load device; and transmitting or receiving the control or status information, only via power supply USB pins, over a power line used for supplying power to the load device, wherein the power negotiation protocol used to exchange the control or status information is a USB Power Delivery protocol.

13. A computer program product comprising non-transitory computer readable code means for producing the steps of the method of claim 12 when run on a computing device.

* * * * *